US011666810B2

(12) United States Patent
Nam

(10) Patent No.: US 11,666,810 B2
(45) Date of Patent: Jun. 6, 2023

(54) PUTTER INCLUDING INTERCHANGEABLE SLEEVE MECHANISM CAPABLE OF EASILY REPLACING AND MOUNTING SHAFT

(71) Applicant: Jong Hyun Nam, Seoul (KR)

(72) Inventor: Jong Hyun Nam, Seoul (KR)

( * ) Notice: Subject to any disclaimer, the term of this patent is extended or adjusted under 35 U.S.C. 154(b) by 0 days.

(21) Appl. No.: 17/966,104

(22) Filed: Oct. 14, 2022

(65) Prior Publication Data

US 2023/0136047 A1 May 4, 2023

(30) Foreign Application Priority Data

Nov. 4, 2021 (KR) ..... 10-2021-0150822

(51) Int. Cl.
*A63B 53/04* (2015.01)

(52) U.S. Cl.
CPC .. *A63B 53/0487* (2013.01); *A63B 2053/0491* (2013.01)

(58) Field of Classification Search
CPC ..... A63B 53/007; A63B 53/02; A63B 53/021; A63B 53/022; A63B 53/023; A63B 53/025; A63B 53/026; A63B 53/027; A63B 53/028; A63B 53/0487; A63B 2053/0491; A63B 53/065
(Continued)

(56) References Cited

U.S. PATENT DOCUMENTS 1,352,020 A * 9/1920 Olson ..... A63B 53/065 D21/734
2,056,335 A * 10/1936 Wettlaufer ..... A63B 60/50 473/245

(Continued)

FOREIGN PATENT DOCUMENTS

CN 204219726 U 3/2015
CN 111840944 A 10/2020

(Continued)

OTHER PUBLICATIONS

DE-202015002383-U1, "Golf club (putter) with (stepless) adjustable Lie angle", by unknown author, Published Dec. 15, 2015. (Year: 2015).*

(Continued)

*Primary Examiner* — Sebastiano Passaniti
(74) *Attorney, Agent, or Firm* — Sughrue Mion, PLLC

(57) ABSTRACT

Disclosed is a putter including an interchangeable sleeve mechanism capable of easily replacing and mounting a shaft, the putter comprising a main body part, a downward extension part, a blade formation part having a plate-shaped structure which extends to a predetermined length rearward from a lower end of the downward extension part and has an area having a predetermined size, a plurality of weight mounting grooves disposed to be spaced a certain interval from each other in an upper surface or a side surface of the blade formation part and configured to bind weights in a detachable structure, and a sleeve mechanism mounted in a structure detachably attached to the binding groove of the main body part, having a block structure extending to a predetermined height upward, and formed with a shaft binding fastening hole recessed to a predetermined depth in an upper end surface.

4 Claims, 11 Drawing Sheets

(58) Field of Classification Search
USPC ..... 473/244–248, 305–315, 313–314, 473/340–341
See application file for complete search history.

(56) References Cited

U.S. PATENT DOCUMENTS

| | | | | | |
|---|---|---|---|---|---|
| 2,661,952 | A * | 12/1953 | Jackson | A63B 53/06 | 403/325 |
| 4,815,740 | A * | 3/1989 | Williams | A63B 53/065 | 403/97 |
| 5,390,919 | A * | 2/1995 | Stubbs | A63B 53/065 | 473/292 |
| 5,407,196 | A * | 4/1995 | Busnardo | A63B 53/02 | 473/307 |
| 5,489,097 | A * | 2/1996 | Simmons | A63B 53/0487 | D21/736 |
| 5,577,726 | A * | 11/1996 | Fenton | A63B 53/02 | 473/340 |
| 5,630,765 | A * | 5/1997 | Moore | A63B 53/0487 | 473/340 |
| 5,716,287 | A * | 2/1998 | Levocz | A63B 53/02 | 473/328 |
| 8,721,472 | B2 * | 5/2014 | Kuan | A63B 53/0487 | 473/340 |
| 9,108,092 | B1 * | 8/2015 | Warner | A63B 53/06 | |
| 9,446,291 | B2 * | 9/2016 | Sanyal | A63B 60/12 | |
| 9,694,260 | B1 * | 7/2017 | Abbott | A63B 60/00 | |
| 10,124,221 | B2 * | 11/2018 | Parsons | A63B 53/04 | |
| 2002/0115498 | A1 * | 8/2002 | Galliers | A63B 53/02 | 473/244 |
| 2003/0060301 | A1 * | 3/2003 | Hsu | A63B 53/0487 | 473/239 |
| 2007/0243943 | A1 | 10/2007 | Inouye et al. | | |
| 2010/0160062 | A1 * | 6/2010 | Teramoto | A63B 60/42 | 473/409 |
| 2015/0045137 | A1 * | 2/2015 | Esposito | A63B 53/04 | 473/307 |
| 2015/0148146 | A1 * | 5/2015 | Wolf | A63B 53/0487 | 473/307 |
| 2015/0151169 | A1 * | 6/2015 | Davis | A63B 53/02 | 473/313 |
| 2016/0303438 | A1 * | 10/2016 | Miles | A63B 53/0487 | |
| 2017/0136322 | A1 | 5/2017 | Green | | |
| 2017/0239535 | A1 * | 8/2017 | Brandt | A63B 53/02 | |
| 2018/0104554 | A1 | 4/2018 | Sanyal et al. | | |
| 2022/0001253 | A1 * | 1/2022 | Müller | A63B 53/0487 | |

FOREIGN PATENT DOCUMENTS

| | | | |
|---|---|---|---|
| JP | 6-9666 | U | 2/1994 |
| JP | 2002-52102 | A | 2/2002 |
| KR | 10-0810786 | B1 | 3/2008 |
| KR | 10-0863259 | B1 | 10/2008 |
| KR | 20-0445545 | Y1 | 8/2009 |
| KR | 10-1217586 | B1 | 1/2013 |
| KR | 10-2017-0068622 | A | 6/2017 |
| KR | 10-2020-0119026 | A | 10/2020 |

OTHER PUBLICATIONS

CA-3030222-A1, "Golf Club Head and Golf Club", by Tezuka Naoki et al, Published Jan. 11, 2018. (Year: 2018).*

JP-2007313304, "Golf Putter", by Kanamori Yasuyuki, Published Dec. 6, 2007. (Year: 2007).*

KR-1965736 B1, "Golf Putter for Golf Club, Has Shaft Contacted With Golf Ball, and Angle Adjusting Part Whose Upper End Portion Side Is Provided With Inclined Surface That Is Contacted With Hosel When Shaft Is Rotated at Opposite Direction", by Park K S, Published Apr. 5, 2019. (Year: 2019).*

Request for the Submission of an Opinion of KR 10-2121-0150822 dated Dec. 28, 2021.

Written Decision on Registration of KR 10-2121-0150822 dated Jan. 3, 2022.

Office Action dated Dec. 13, 2022 issued by the Japanese Patent Office in Japanese Application No. 2022-158104.

* cited by examiner

CROSS-SECTIONAL VIEW ALONG LINE A-A'

PUTTER INCLUDING INTERCHANGEABLE SLEEVE MECHANISM CAPABLE OF EASILY REPLACING AND MOUNTING SHAFT

CROSS-REFERENCE TO RELATED APPLICATION

This application claims priority to and the benefit of Korean Patent Application No. 10-2021-0150822, filed on Nov. 4, 2021, the disclosure of which is incorporated herein by reference in its entirety.

BACKGROUND

1. Field of the Invention

The present disclosure relates to a putter, and more specifically, to a putter including an interchangeable sleeve mechanism capable of easily replacing and mounting shafts having various specifications.

2. Discussion of Related Art

Golf is a sport in which it is advantageous when a score smaller than a prescribed number of strokes is recorded more for 18 holes, each of which is finished by performing a tee shot using a driver on a tee box, then performing second and third shots or approach using woods, irons, utility clubs, and wedge clubs to seat a ball on a green, and then putting the ball into the hole formed on the green using a putter.

In order to play golf, the last club used to put the ball disposed on the green into a hole cup is the putter, various types of putters have also been developed and provided to users, and representatively, the putter is largely classified into a blade type (or anser type) having a straight head shape and a mallet type having a large head having a protrusion rearward from the head.

Recently, new types of putters with functional parts added have been developed by breaking away from the basic types of anser type or mallet type, and representative examples will be described through patent documents as follows.

Patent Document 1 discloses that a golf putter compose of a coupling part 2 formed so that an upper shaft 1 having a grip provided on an upper portion is fitted and coupled thereto, and a putter head 3 composed of a striking part 3b connected to a lower portion of the coupling part 2 and having a front striking surface 3a of a lower tip coming into contact with a golf ball, and a rear weight 3c formed integrally with the rear of the striking part 3b for adjusting a weight and holding the center of gravity further includes a support rod 10 having one end integrally connected to an upper surface of the striking part 3b on a line parallel to the front striking surface 3a, and the other end formed with a ring 11 fitted into an outer circumferential surface of the upper shaft 1.

Patent Document 2 discloses that, in a golf putter having a shaft having a grip provided on one end and a head coupled to an end of the shaft, the head includes a striking part for striking a golf ball on a front surface, and a connection member connected to the shaft on an upper portion of the striking part, the connection member is formed with an insertion part having an insertion hole into which the end of the shaft is inserted, and has a triangular cross section in which one vertex portion is connected to the insertion part and the remaining two vertex portions are connected to both ends of the striking part, and the striking part of the head is formed with straight protrusions consecutively repeated in a horizontal direction, wherein at least one or more recesses are formed in the straight protrusion.

Patent Document 3 discloses that a golf putter includes a shaft having a grip part formed on an upper end, a striking part detachably coupled to a lower end of the shaft and configured to strike a golf ball as a semi-track-shaped member, and a connection part configured to connect the striking part to the shaft, wherein the connection part includes a shaft coupling pipe having a through hole vertically formed to pass through the lower end of the shaft and coupled to a part of the passed-through lower end of the shaft, a left connection shaft integrally formed on a lower left portion of the shaft coupling pipe, formed to extend leftward and downward from the shaft coupling pipe, and having a coupling protrusion formed on an extended end; and a right connection shaft integrally formed on a lower right portion of the shaft coupling pipe, formed to extend rightward and downward from the shaft coupling pipe, and having a coupling protrusion formed on an extended end, the striking part has a striking area where a golf ball is struck formed on a front surface, and has a connection shaft coupling groove formed to be parallel and correspond to the coupling protrusion formed on an upper surface as a groove-shaped member, and a shaft coupling groove formed at a position coupled to the lower end of the shaft passing through the shaft coupling pipe between the connection shaft coupling grooves as the groove-shaped member formed in an upper surface, the connection part and the striking part are separately coupled, and the shaft passes through the shaft coupling pipe and is coupled to the striking part, thereby removing a torsional phenomenon while preventing an elastic increase phenomenon acting on the end of the shaft upon putting.

In the above-described patent documents to which the related art is applied, the golf putters are provided in the form of integrally connecting the bridge to the upper portion of the head in both directions or being disassembled from and assembled to or forcefully fitted into the head, and have the form of coupling the shaft to the upper portion of the bridge.

In the above configurations, since the center of gravity of the head is positioned on the top due to a bridge for connection to the shaft further connected to the upper portion of the head, a phenomenon in which a bottom surface of the head may not move stably like a pendulum and swings in a state of being almost connected to the ground when a user performs a swing operation in a putting process occurs.

In addition, due to the high center of gravity, since the swing is performed in the state in which the bottom surface of the head may not maintain an interval at which it is almost connected to the ground and is spaced apart from the ground by a considerable height unlike the user's intention, a phenomenon in which the ball may not be struck on a swing spot of the head and is struck at a position beyond the swing spot at the moment when the ball is struck often occurs.

Since a phenomenon in which the center of gravity of the head is biased to any one place by the bridge and thus a toe and heel of the head may not maintain horizontality (balance) and are tilted to a place where a weight is concentrated occurs, there appears a problem in that the head tends not to maintain its position in the putting process and the user has difficulty in accurately staring at the ball because the bridge blocks the user's view.

Due to the problem, since the user may not send the ball as far as a target distance in the putting process and may not roll the ball along an intended trajectory, various problems in which the number of strokes increases by failing to put the ball into the hole cup, thereby significantly degrading putting efficiency and the like occur.

In order to solve the problems, as shown in FIG. 1, a structure in which a weight is fastened to an upper surface of a head according to a user's intention has been developed, but there is a limitation in solving the problems caused by the related art.

Accordingly, there is a need for a technique for solving the above problems caused by the related art.

RELATED ART DOCUMENTS

Patent Documents (Patent Document 1) Korean Utility Model Registration No. 20-0445545 (registered on Aug. 3, 2009)

(Patent Document 2) Korean Registration Patent No. 10-0810786 (registered on Feb. 28, 2008)

(Patent Document 3) Korean Registration Patent No. 10-1217586 (registered on Dec. 26, 2012)

SUMMARY

The present disclosure is directed to providing a putter in which an optimal shaft customized to a body shape, a condition, and a use environment of a user may be easily replaced and mounted, and the center of gravity of a putter head is customized to the user's body shape, condition, and use environment to arrange the center of gravity of the putter head at an optimal position, and as a result, includes a structure which may be customized to a golfer's putting style considering a toe hang balance, a heel balance, and a weightless balance.

A putter according to one aspect of the present disclosure includes a main body part having a block structure extending to a predetermined length in a direction perpendicular to a putting stroke direction and provided with a binding groove in which a sleeve mechanism is bound to be rotated at a predetermined angle formed in one side surface thereof, a downward extension part protruding to a predetermined length forward from one side surface of the main body part, then extending to a predetermined depth downward, and formed with a head face having a predetermined area, a blade formation part formed in a plate-shaped structure which extends to a predetermined length rearward from a lower end of the downward extension part and has an area having a predetermined size, a plurality of weight mounting grooves disposed to be spaced a certain interval from each other in an upper surface or a side surface of the blade formation part and configured to bind weights in a detachable structure, and a sleeve mechanism mounted in a structure detachably attached to the binding groove of the main body part, having a block structure extending to a predetermined height upward, and formed with a shaft binding fastening hole recessed to a predetermined depth in an upper end surface.

In one embodiment of the present disclosure, the main body part may include a first fastening hole formed in a structure recessed to a predetermined depth in one end surface in the direction perpendicular to the putting stroke direction and having a structure bolt-fastened with a first weight, and a second fastening hole formed in a structure recessed to a predetermined depth in the other end surface in the direction perpendicular to the putting stroke direction and having a structure bolt-fastened with a second weight.

In one embodiment of the present disclosure, the binding groove of the main body part may include a central groove having a structure recessed to a predetermined depth at a center of one side of the rear of the main body part and an inclined surface having a structure which forms both sidewalls of the central groove and is tilted at an acute angle in a vertical symmetry form with respect to a virtual horizontal line passing through a center of a hinge binding hole, and the hinge binding hole formed at a center of the central groove, and bolt-fastened to the sleeve mechanism.

In this case, the inclined surface may have a structure tilted to come into surface contact with one side surface of the sleeve mechanism when the sleeve mechanism is tilted in one side direction with respect to the hinge binding hole.

In addition, the downward extension part may include a front connection portion having an upper surface structure which extends to a predetermined length from an upper portion of one side surface facing the front of the main body part and is continued from an upper surface of the main body part, a face formation portion formed with the head face extending to a predetermined length downward from a lower surface of one end of the front connection portion and forming a loft angle, and a separation space part formed between a lower portion of the one side surface facing the front of the main body part and the face formation part.

In one embodiment of the present disclosure, the blade formation part may include one side blade disposed on one side in the direction perpendicular to the putting stroke direction, formed in a curved structure having a radius of a predetermined length rearward from a lower end of the downward extension part, and having a structure formed to protrude to a predetermined height from an upper surface of one side to increase a weight of the blade formation part, and the other side blade disposed on the other side in the direction perpendicular to the putting stroke direction, formed in a curved structure having a radius of a predetermined length rearward from the lower end of the downward extension part, and having a structure formed to protrude to a predetermined height from an upper surface of the other side to increase a weight of the blade formation part.

In this case, a plurality of weight mounting grooves are spaced a certain interval from each other and disposed along an edge of the curved structure in a portion formed to protrude from the one side blade, and the plurality of weight mounting grooves are spaced a certain interval from each other and disposed along an edge of the curved structure in a protrusion portion of the other side blade.

In addition, the portions formed to protrude from the upper surfaces of the one side blade and the other side blade may be formed in a structure recessed in the direction parallel to the putting stroke direction.

In one embodiment of the present disclosure, the sleeve mechanism may include a sleeve main body portion having a quadrangular column structure which has a bolt fastening hole, which may be bolt-fastened to the binding groove of the main body part, formed on one side surface, and extends to a predetermined height upward; and a shaft binding fastening hole having a structure recessed to a predetermined depth in an upper end surface of the sleeve main body portion bolt-fastened to one end of the shaft.

In the one embodiment of the present disclosure, the putter may include a control part mounted inside the main body part and configured to control operations of a center of gravity variation part, a sleeve angle change part, and a light-emitting display part on the basis of a preset input value and data acquired from a first detection part and a second detection part, a wireless communication module mounted inside the control part and configured to receive an input value input by a user by wirelessly interlocking with the user's smart device to transmit the input value to the control part and transmit to the control part a signal received from a switch part by wirelessly interlocking with the switch part, a first detection part mounted inside the downward extension part and configured to detect an amount of impact and contact position with a golf ball detected from a head face to transmit the amount of impact and the contact position to the control part, a second detection part mounted on a lower surface of the blade formation part and configured to detect a proceeding direction of a putter head in real time and transmit to the control part a stroke proceeding direction of the putter head just before a time point at which the amount of impact is detected from the first detection part, the center of gravity variation part mounted in a changeable position structure inside the main body part and having a structure which has a changeable position in a direction parallel to a longitudinal direction in which the main body part extends by a control signal of the control part and having a weight of a predetermined size, a sleeve angle change part mounted on one side surface of the main body part and having a structure operated by the control signal of the control part to change a slope of the sleeve mechanism, a light-emitting display part mounted to independently emit light to each of the weight mounting grooves and operated according to the control signal of the control part, a switch part attached to a grip portion of a shaft bound to the sleeve mechanism and configured to receive a signal value by a pressing operation of a user's finger to transmit the input signal to the wireless communication module, and an image output part mounted on an upper surface of the blade formation part and configured to visually output data related to a putting operation according to the control signal received from the control part.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, exemplary embodiments of the present disclosure will be described in detail with reference to the accompanying drawings. Prior to this, the terms or words used in this specification and claims should not be construed as being limited to general or dictionary meanings, and should be construed as meanings and concepts consistent with the technical spirit of the present disclosure.

Throughout this specification, when a certain member is described as being positioned "on" another member, this includes not only a case in which a certain member is in contact with another member but also a case in which other members are present between the two members. Throughout this specification, when a certain part "includes" a certain component, it means that other components may be further included other than excluding other components unless otherwise stated.

Figure 1:
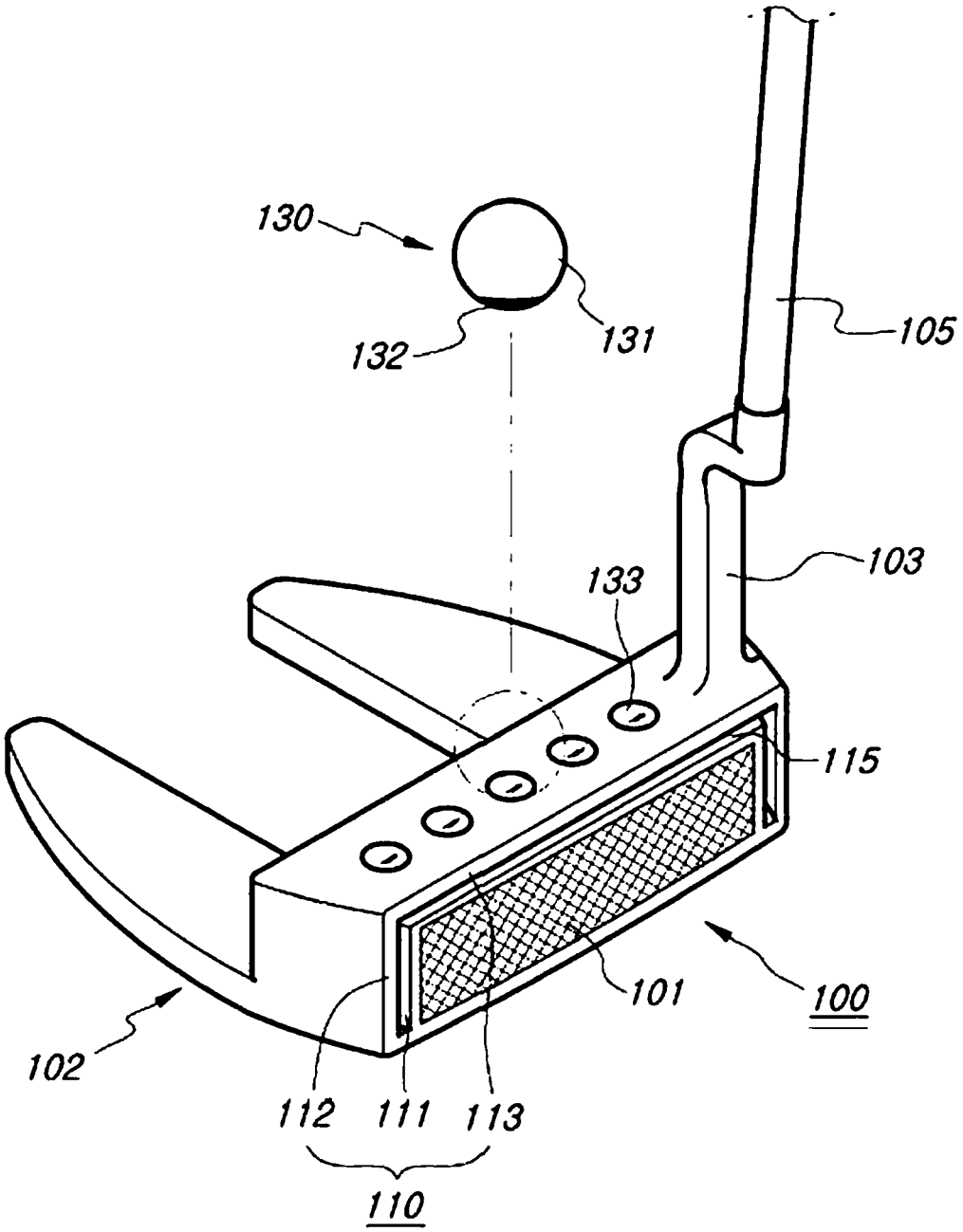
FIG. 1 PRIOR ART
FIG. 1 is a perspective view showing a putter according to the related art.
Figure 2:
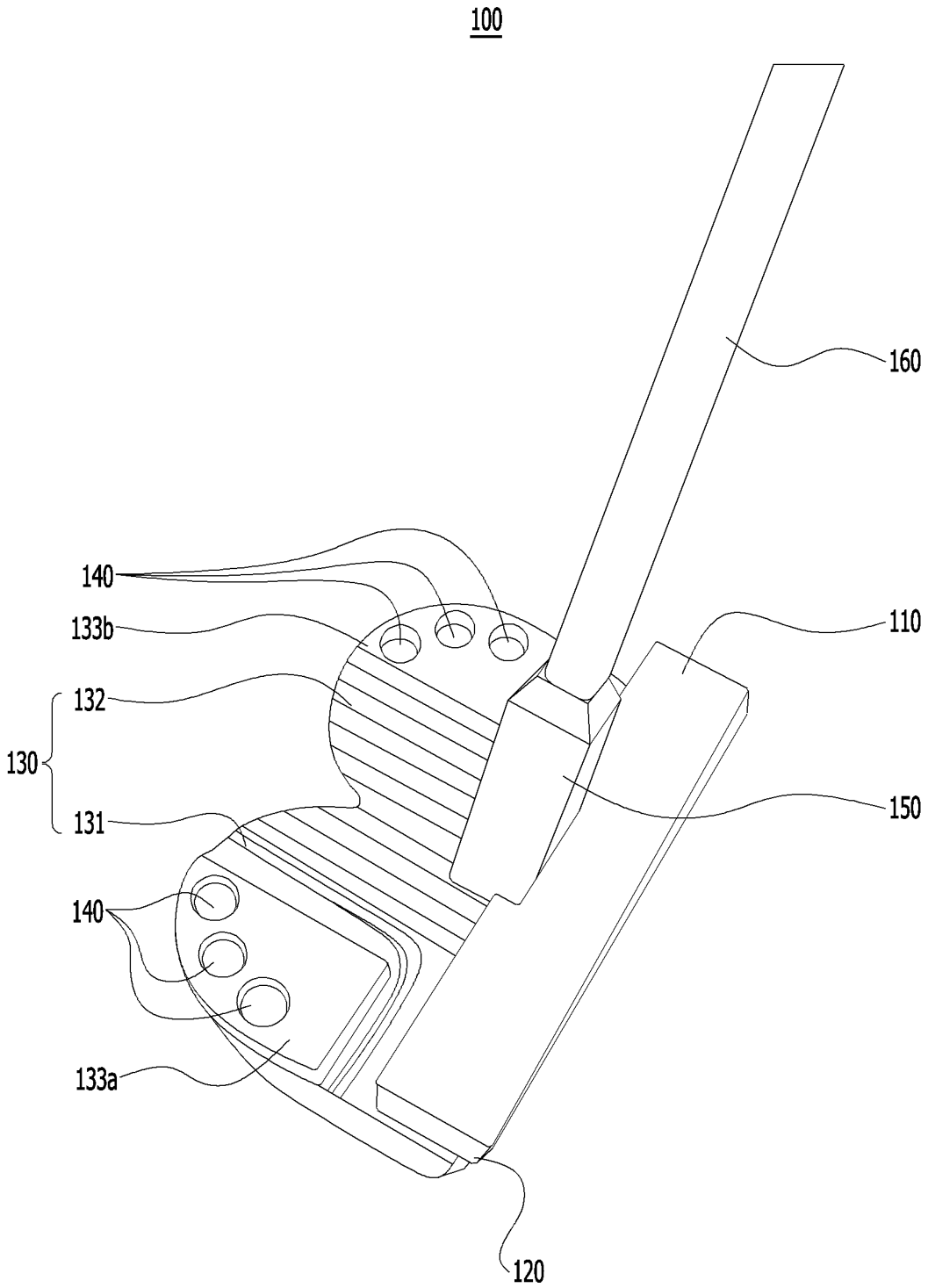
FIG. 2 is a photo showing a putter according to one embodiment of the present disclosure.
Figure 3:
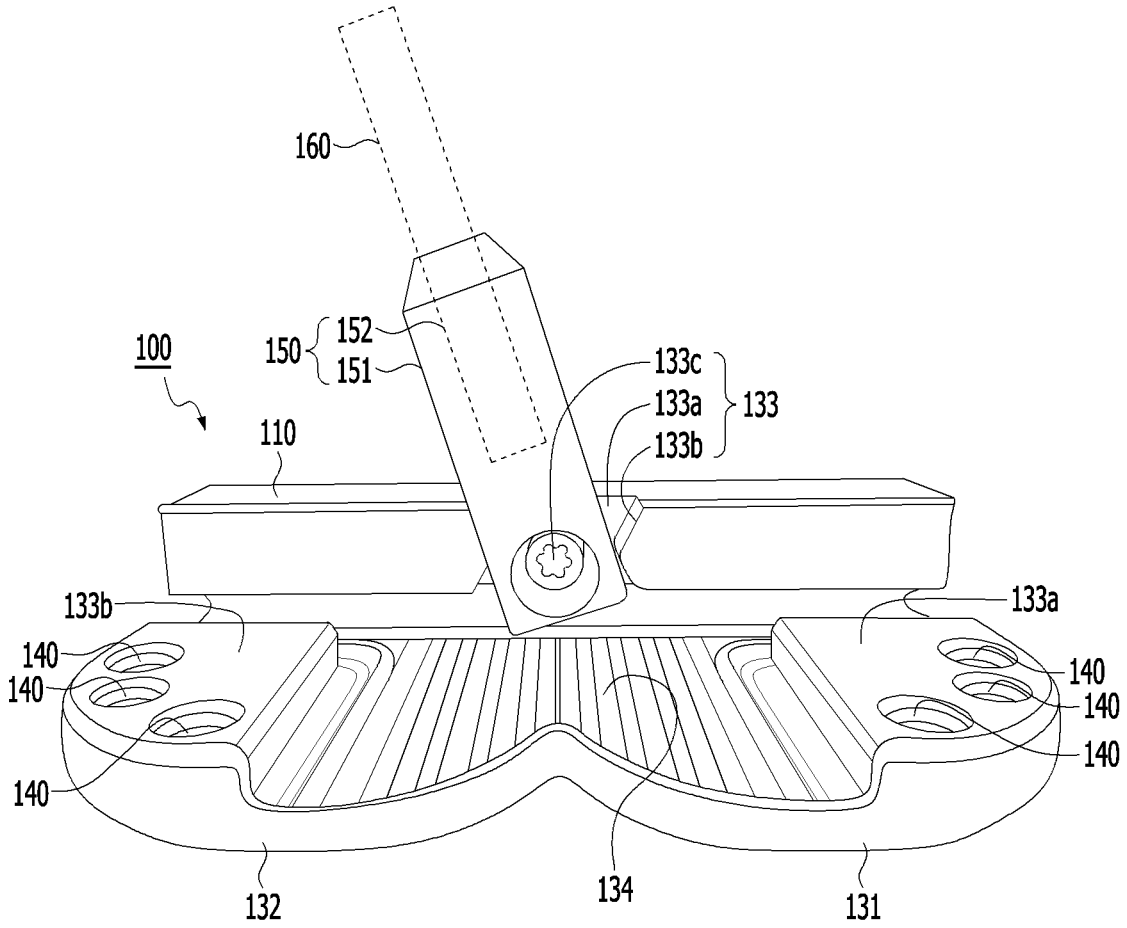
FIG. 3 is a photo showing the putter shown in FIG. 2.

FIG. 2 shows a photo showing a putter according to one embodiment of the present disclosure, and FIG. 3 shows a photo showing the putter shown in FIG. 2.

Referring to the drawings, a putter 100 according to the embodiment may include a main body part 110, a downward extension part 120, a blade formation part 130, a weight mounting groove 140, and a sleeve mechanism 150 having specific structures, and thus allow an optimal shaft customized to a body shape, a condition, and a use environment of a user to be easily replaced and mounted and the center of gravity of a putter head to be customized to the user's body shape, condition, and use environment to arrange the center of gravity of the putter head at an optimal position, and as a result, includes a structure which can be customized to a golfer's putting style considering a toe hang balance, a heel balance, and a weightless balance.

Hereinafter, each configuration constituting the putter 100 according to the embodiment will be described in detail with reference to the drawings.

Figure 4:
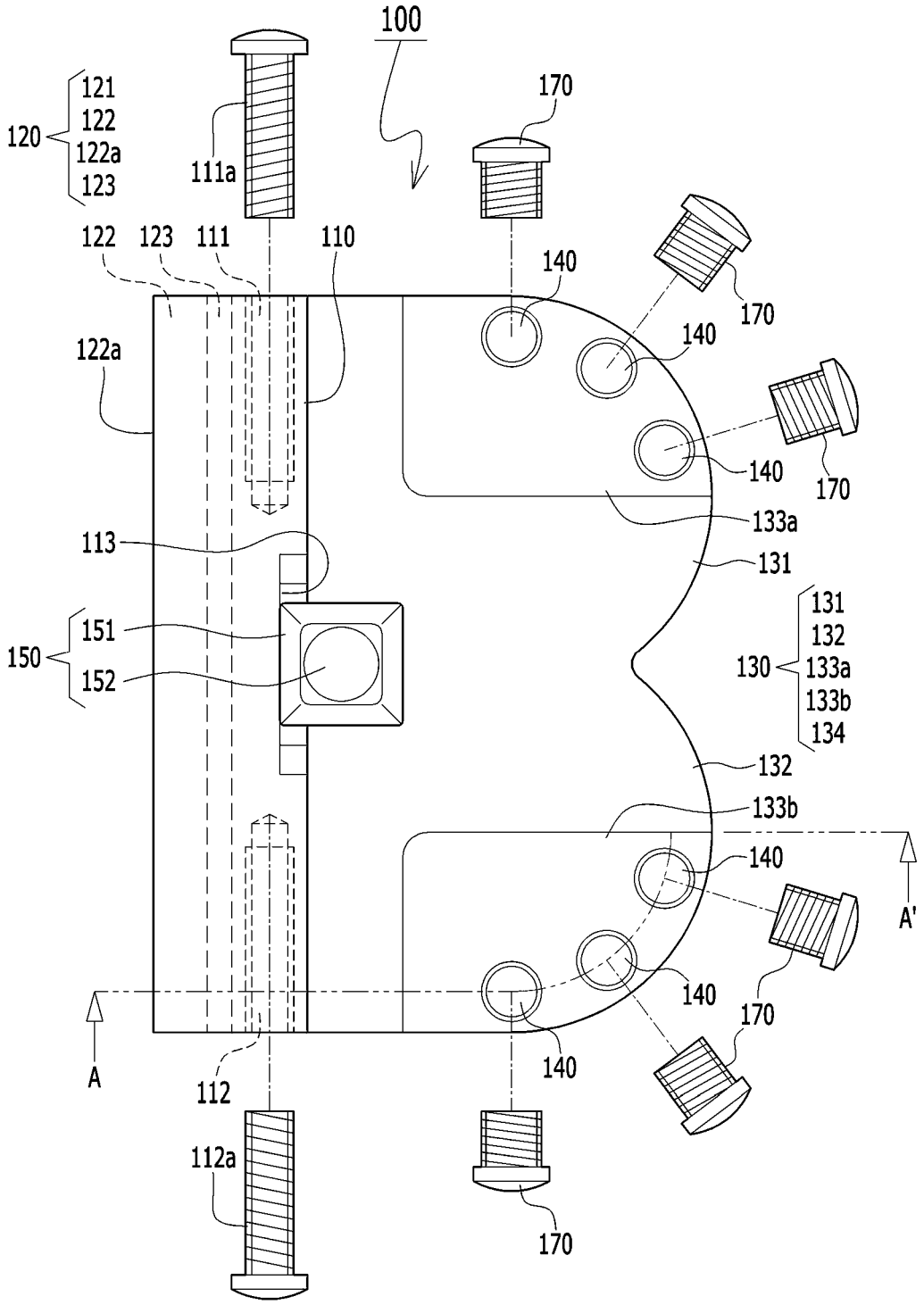
FIG. 4 is a plan view showing the putter according to one embodiment of the present disclosure.
Figure 5:
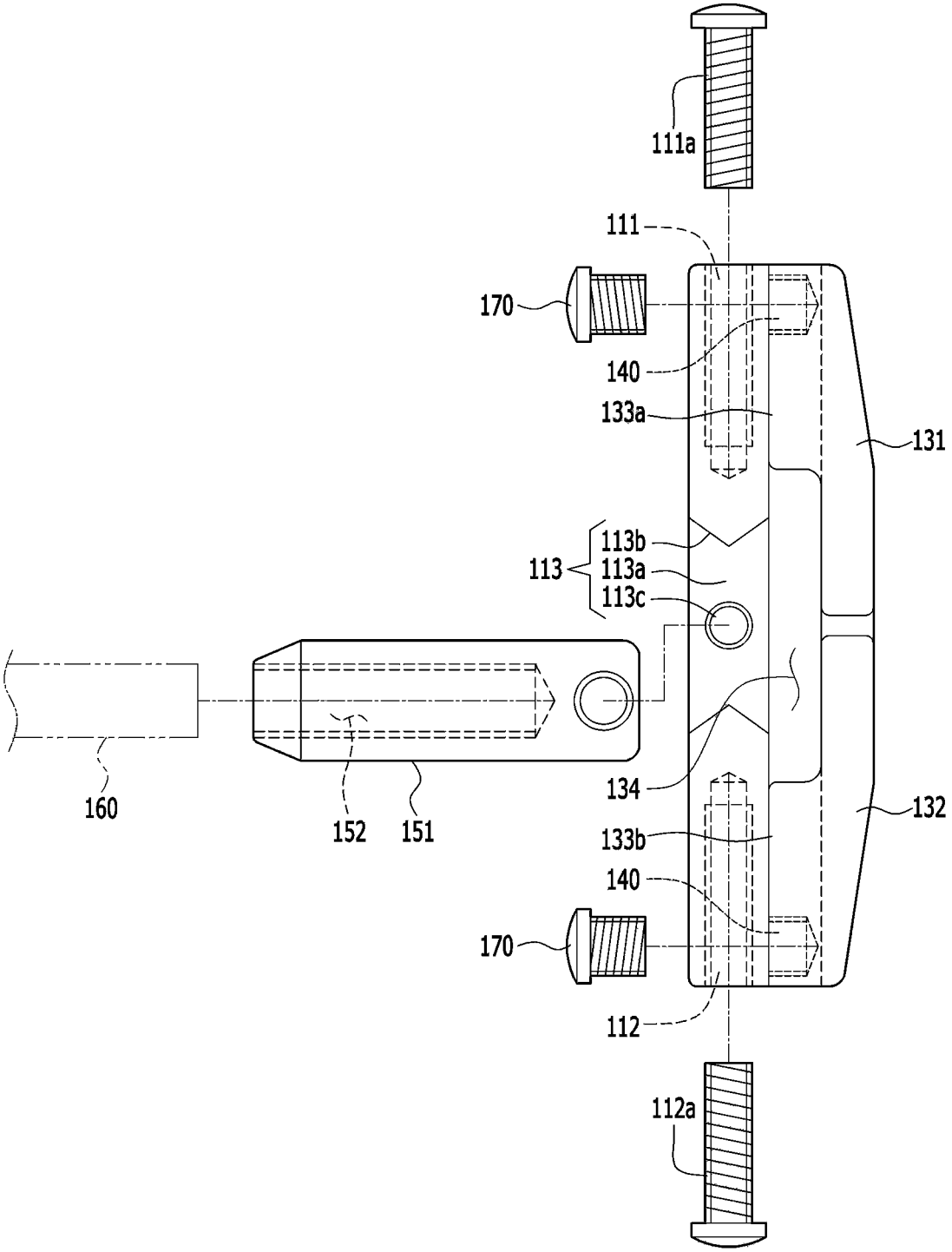
FIG. 5 is a right-side view of FIG. 4.
Figure 6:
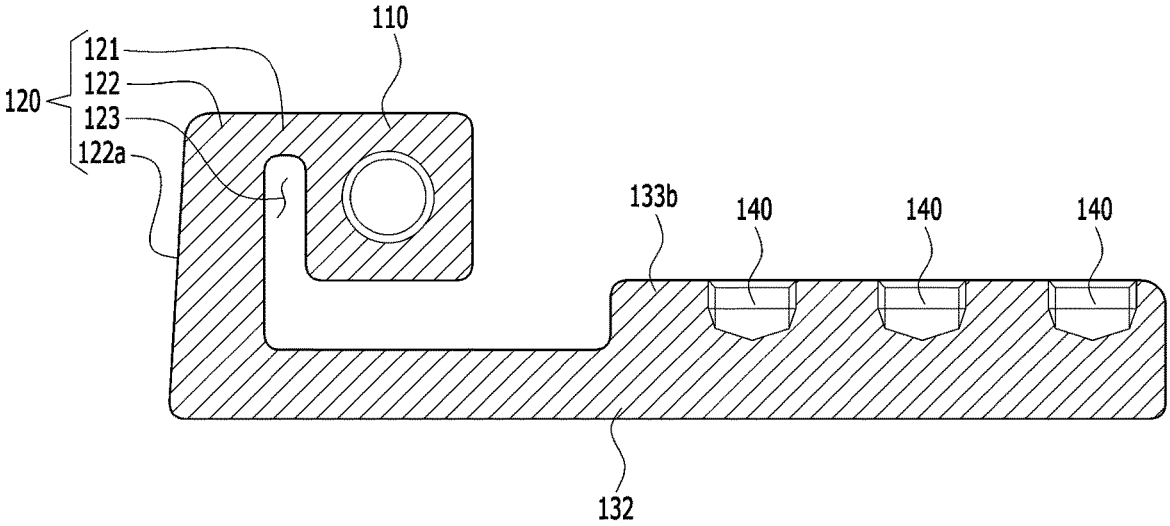
FIG. 6 is a cross-sectional view along line A-A' in FIG. 4.

FIG. 4 is a plan view showing the putter according to one embodiment of the present disclosure, FIG. 5 is a right-side view of FIG. 4, and FIG. 6 is a cross-sectional view along line A-A' in FIG. 4.

Referring to the drawings, the main body part 110 of the putter 100 according to the embodiment may have a block structure extending to a predetermined length in a direction perpendicular to a putting stroke direction and have a structure in which a binding groove 113 in which the sleeve mechanism 150 is bound to be rotated at a predetermined angle is formed in one side surface.

Specifically, as shown in FIGS. 4 and 5, the main body part 110 according to the embodiment may include a first fastening hole 111 and a second fastening hole 112 having specific structures. The first fastening hole 111 is formed in a structure which is recessed to a predetermined depth in one end surface in a direction perpendicular to the putting stroke direction and has a structure bolt-fastened with a first weight 111*a*. In addition, the second fastening hole 112 is formed in a structure which is recessed to a predetermined depth in the other end surface in a direction perpendicular to the putting stroke direction and has a structure bolt-fastened with a second weight 112*a*.

As shown in FIGS. 4 and 5, the binding groove 113 of the main body part 110 may include a central groove 113*a*, an inclined surface 113*b*, and a hinge binding hole 113*c* having specific structures. The central groove 113*a* of the binding groove 113 has a structure recessed to a predetermined depth at a center of one side surface of the rear of the main body part 110. The inclined surface 113*b* of the binding groove 113 has a structure which forms both sidewalls of the central groove 113*a* and is tilted at an acute angle in a vertical symmetry form with respect to a virtual horizontal line passing through a center of the hinge binding hole 113*c*. In this case, the inclined surface 113*b* has a structure tilted to come into surface contact with one side surface of the sleeve mechanism when the sleeve mechanism is tilted in one side direction with respect to the hinge binding hole 113*c*. In addition, the hinge binding hole 113*c* of the binding groove 113 may be formed at a center of the central groove 113*a*, and bolt-fastened to the sleeve mechanism.

The downward extension part 120 according to the embodiment may have a structure which protrudes to a predetermined length forward from one side surface of the main body part 110, then extends to a predetermined depth downward, and is formed with a head face 122*a* having a predetermined area.

Specifically, the downward extension part 120 may include a front connection portion 121, a face formation portion 122, and a separation space portion 123 having specific structures. The front connection portion 121 of the downward extension part 120 is formed in an upper surface structure which extends to a predetermined length from an upper portion of one side surface facing the front of the main body part 110 and is continued from an upper surface of the main body part 110. The face formation portion 122 of the downward extension part 120 is formed with the head face 122*a* which extends to a predetermined length downward from a lower surface of one end of the front connection portion 121 and forms a loft angle. In addition, the separation space portion 123 of the downward extension part 120 is formed between a lower portion of one side surface facing the front of the main body part 110 and the face formation portion 122.

A plurality of weight mounting grooves 140 according to the embodiment may be spaced a certain interval from each other in an upper surface of the blade formation part 130 and may bind weights 170 in a detachable structure.

The blade formation part 130 according to the embodiment may be formed in a plate-shaped structure which extends to a predetermined length rearward from a lower end of the downward extension part 120 and has an area having a predetermined size.

Specifically, as shown in FIG. 4, the blade formation part 130 may include one side blade 131 and the other side blade 132 having specific structures. The one side blade 131 is disposed on one side in the direction perpendicular to the putting stroke direction, formed in a curved structure having a radius of a predetermined length rearward from the lower end of the downward extension part 120 and has a structure formed to protrude to a predetermined height from an upper surface of one side to increase a weight of the blade formation part 130. The other side blade 132 is disposed on the other side in the direction perpendicular to the putting stroke direction, is formed in a curved structure having a radius of a predetermined length rearward from the lower end of the downward extension part 120, and has a structure formed to protrude to a predetermined height from an upper surface of the other side to increase the weight of the blade formation part 130.

In this case, the plurality of weight mounting grooves 140 are spaced a certain interval from each other and disposed along an edge of the curved structure in a portion formed to protrude from the one side blade 131, and the plurality of weight mounting grooves 140 are spaced a certain interval from each other and disposed along the edge of the curved structure in a portion formed to protrude from the other side blade 132.

In this case, as shown in FIG. 5, portions 133*a* and 133*b* formed to protrude from upper surfaces of the one side blade 131 and the other side blade 132 are formed in a structure 134 recessed in the direction parallel to the putting stroke direction.

In this case, the embodiment can provide the putter which includes the main body part 110 including the first fastening hole 111 and the second fastening hole 112 having specific structures, and the blade formation part 130 which arranges the plurality of weight mounting grooves 140 at specific positions, and thus allows the center of gravity of a putter head to be customized to the user's body shape, condition, and use environment to arrange the center of gravity of the putter head at an optimal position, and as a result, includes a structure which can be customized to a golfer's putting style considering a toe hang balance, a heel balance, and a weightless balance.

In addition, as a configuration mounted in the binding groove of the main body part 110 in a detachable structure, the sleeve mechanism 150 according to the embodiment may have a block structure extending to a predetermined height upward, and have a structure in which a shaft binding fastening hole 152 recessed to a predetermined depth in an upper end surface is formed.

Specifically, the sleeve mechanism 150 may include a sleeve main body portion 151 and a shaft binding fastening hole 152 having specific structures. The sleeve main body portion 151 of the sleeve mechanism 150 has a quadrangular column structure which has a bolt-fastening hole, which may be bolt-fastened to the binding groove of the main body part 110, formed on one side surface, and extends to a predetermined height upward. In addition, the shaft binding fastening hole 152 has a structure recessed to a predetermined depth in an upper end surface of the sleeve main body portion 151 and bolt-fastened to one end of a shaft 160.

Figure 7:
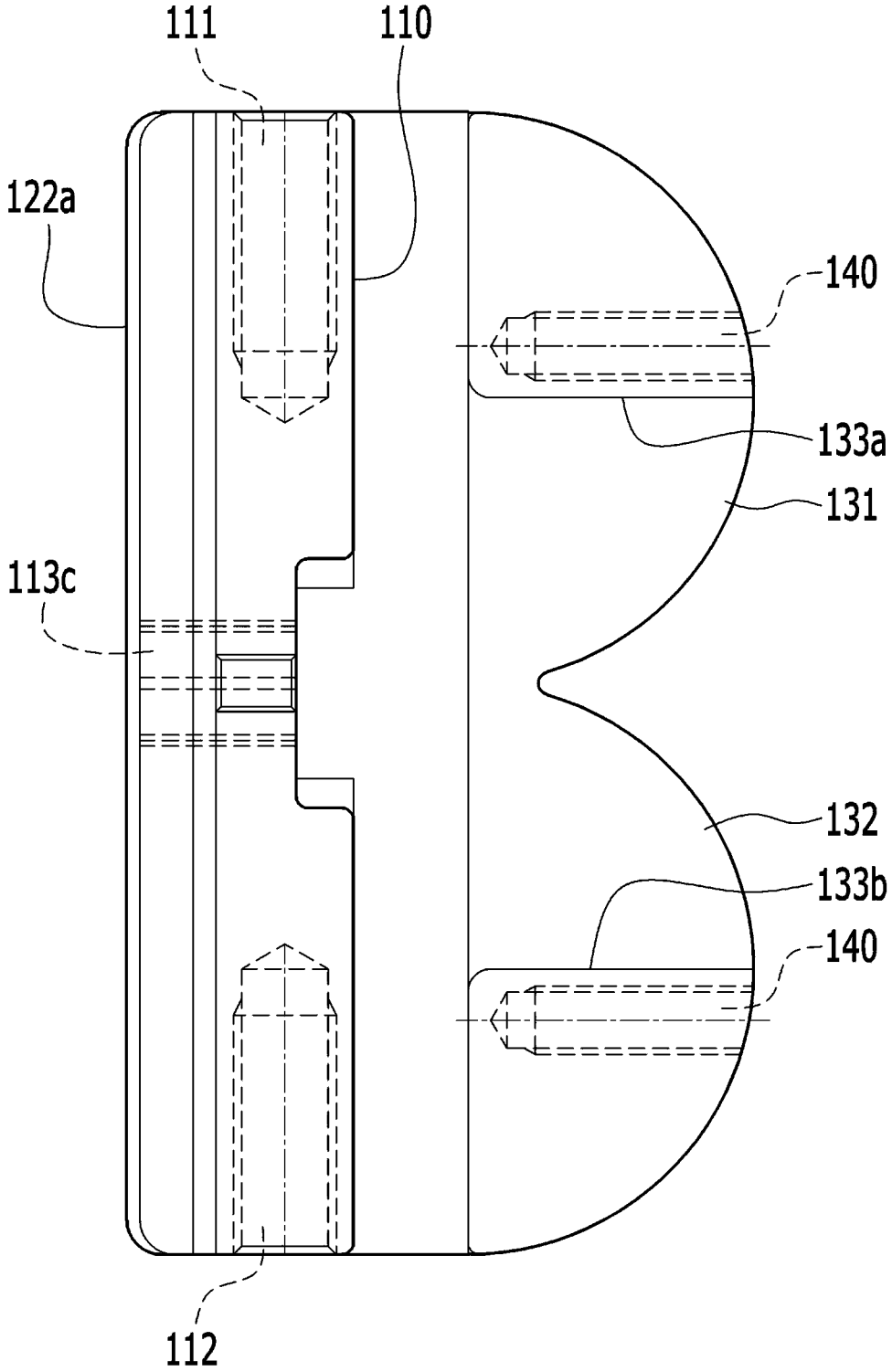
FIG. 7 is a plan view showing a putter according to another embodiment of the present disclosure.
Figure 8:
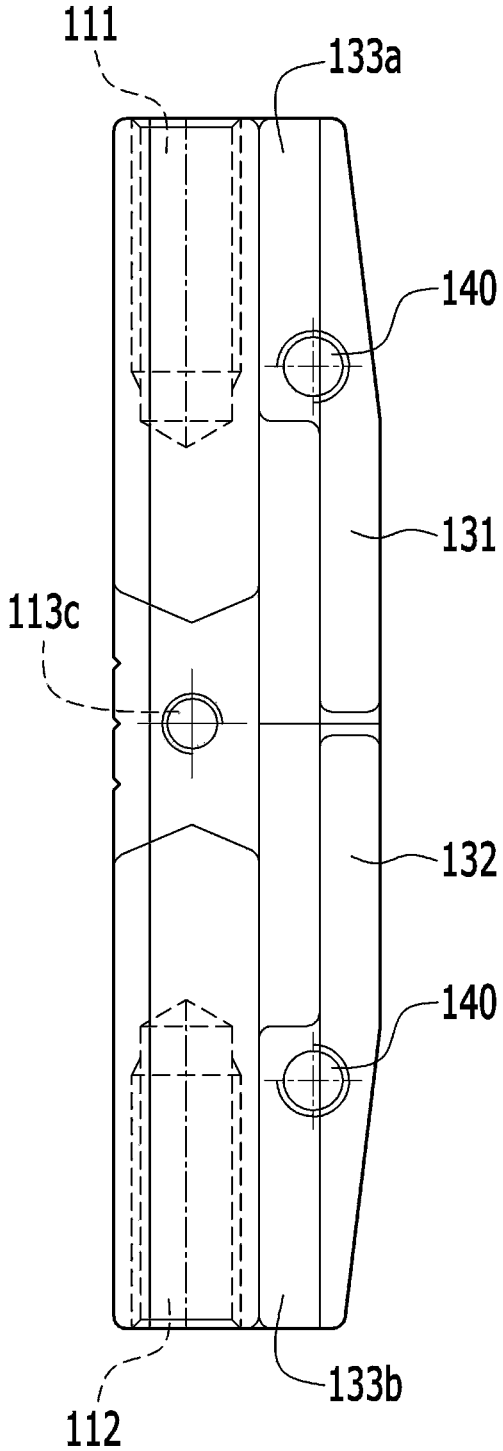
FIG. 8 is a right-side view of FIG. 7.

Meanwhile, FIG. 7 is a plan view showing a putter according to another embodiment of the present disclosure, and FIG. 8 shows a right-side view of FIG. 7.

As shown in these drawings, the weight mounting groove 140 according to the embodiment may be formed in a structure recessed to a predetermined depth in a side surface facing the side of each of the one side blade 131 and the other side blade 132 of the blade formation part 130. It does go without saying that a formation direction of the weight mounting groove 140 may be variously formed in an outer surface of the blade formation part 130 according to a designer's intention and a user's intention.

The embodiment including the above-described configuration may provide the putter which includes the sleeve mechanism 150 including the sleeve main body portion 151 and the shaft binding fastening hole 152 having specific structures and thus allows the optimal shaft customized to be easily replaced and mounted to the user's body shape, condition, and use environment.

Figure 9:
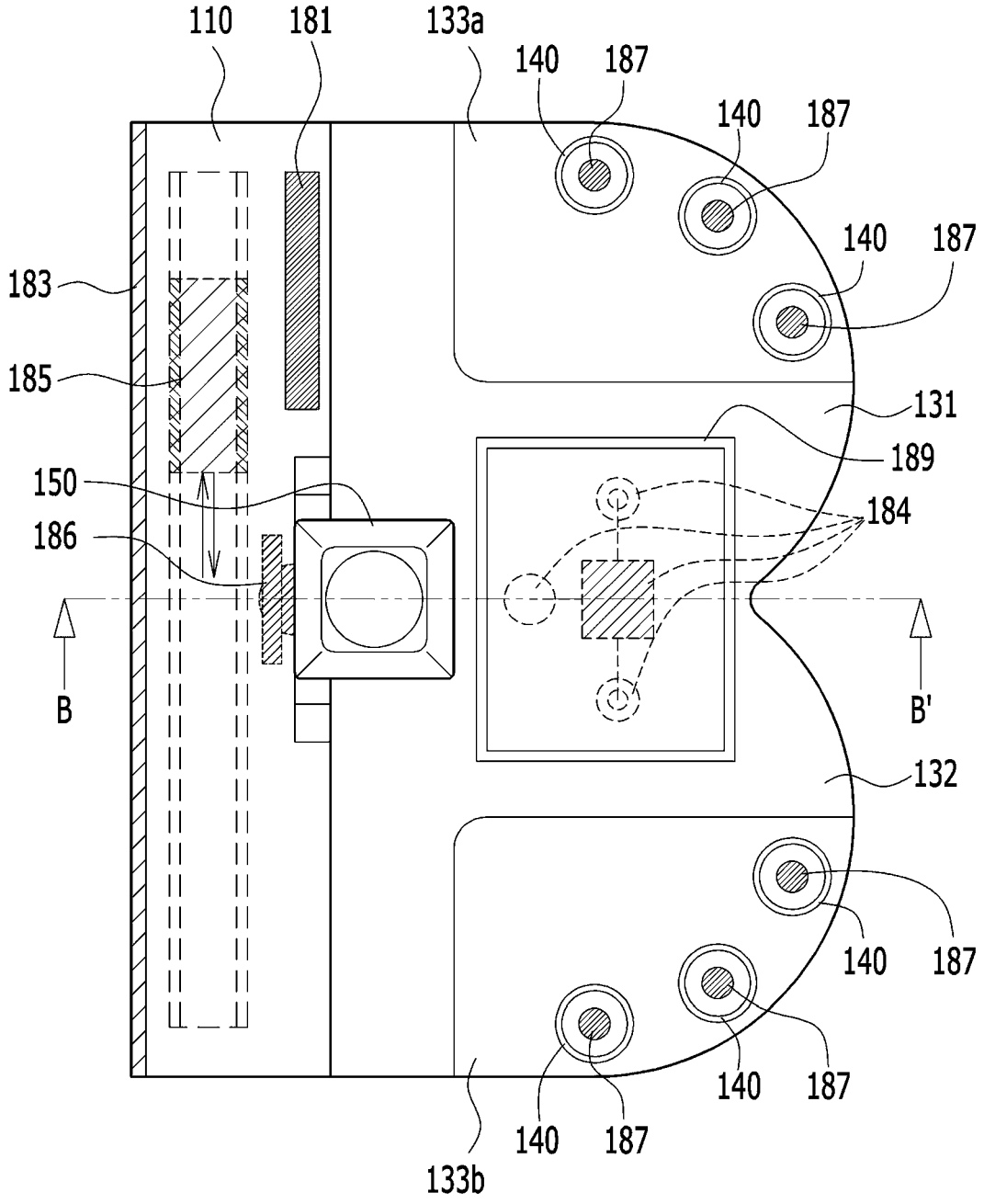
FIG. 9 is a plan view showing a putter according to still another embodiment of the present disclosure.
Figure 10:
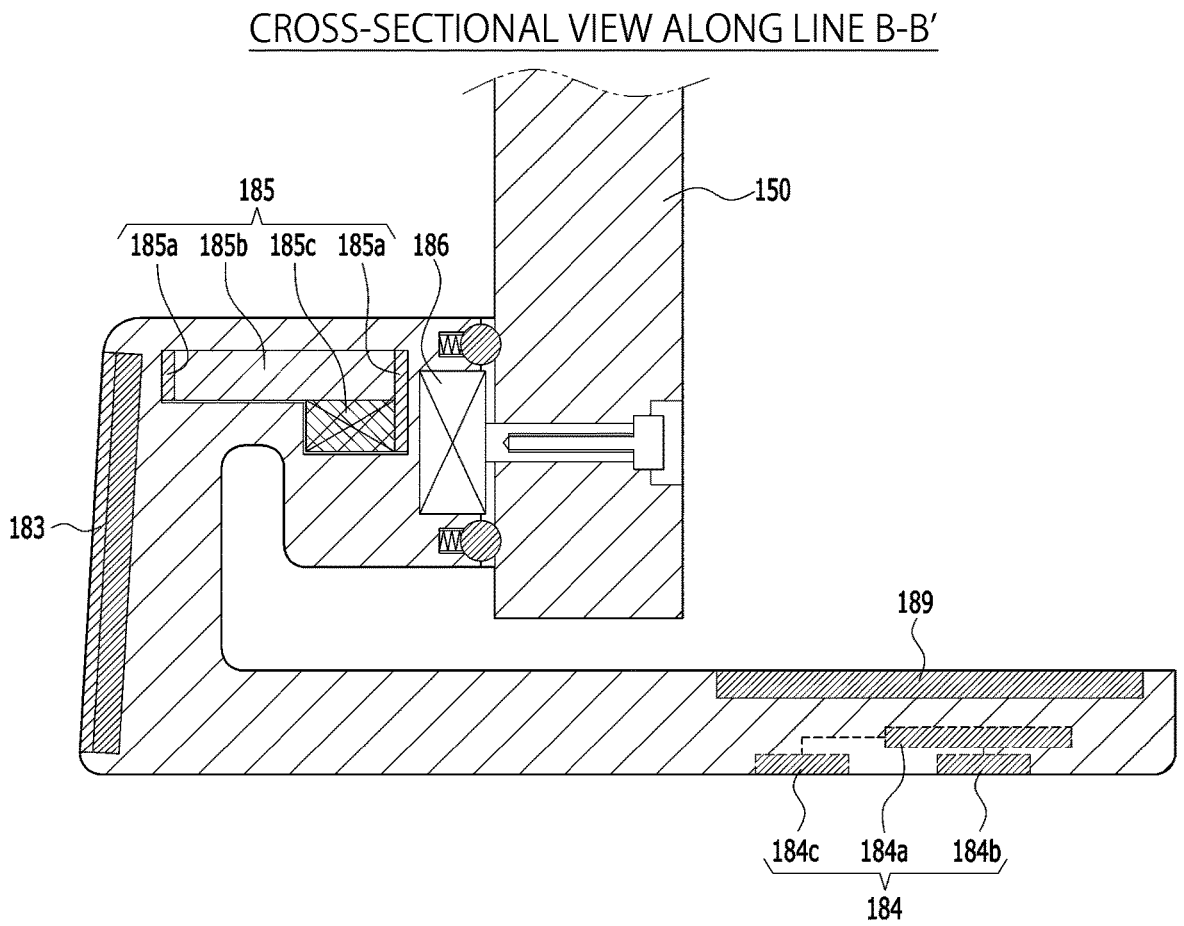
FIG. 10 is a cross-sectional view along line B-B' in FIG. 9.
Figure 11:
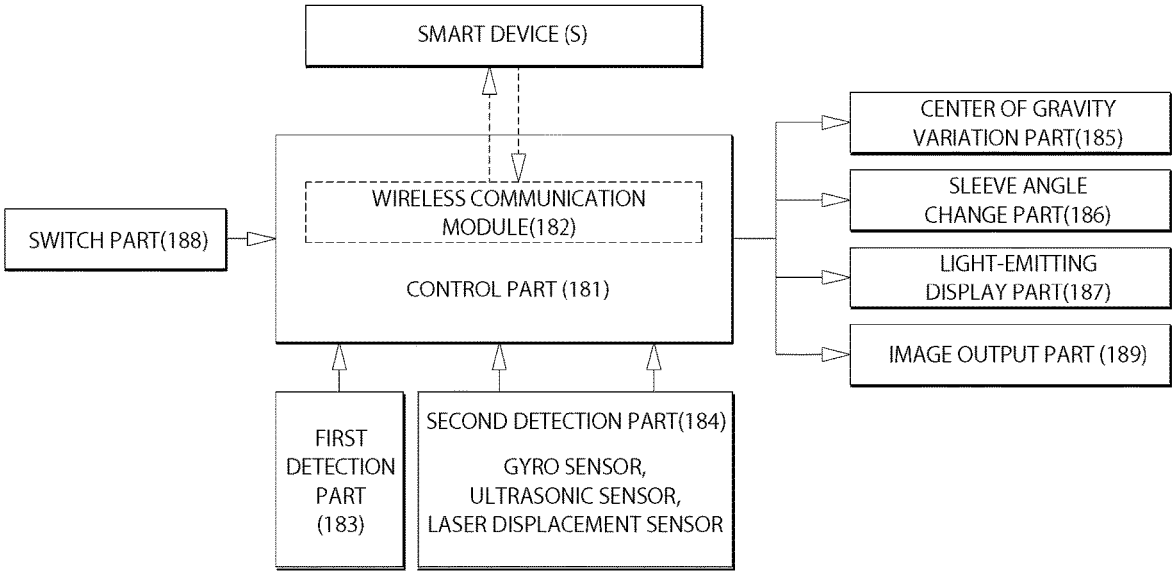
FIG. 11 is a control configuration diagram showing a control flow of the putter according to another embodiment of the present disclosure.

FIG. 9 is a plan view showing a putter according to still another embodiment of the present disclosure, and FIG. 10 is a cross-sectional view along line B-B' in FIG. 9. In addition, FIG. 11 shows a control configuration diagram showing a control flow of the putter according to another embodiment of the present disclosure.

Referring to the drawings, a putter 100 according to the embodiment may include a control part 181, a wireless communication module 182, a first detection part 183, a second detection part 184, a center of gravity variation part 185, a sleeve angle change part 186, a light-emitting display part 187, a switch part 188, and an image output part 189, which perform specific functions.

Specifically, as a configuration mounted inside the downward extension part 120, the first detection part 183 according to the embodiment may detect an amount of impact and contact position with a golf ball detected from the head face 122*a* and transmit the amount of impact and the contact position to the control part 181. In addition, as a configuration mounted on the lower surface of the blade formation part 130, the second detection part 184 may detect a proceeding direction of the putter head in real time and transmit to the control part 181 a stroke proceeding direction of the putter head just before a time point at which the amount of impact is detected from the first detection part 183. In this case, the second detection part 184 may have a configuration in which a plurality of sensors are combined to accurately detect the movement of the putter head, and for example, may include a gyro sensor 184*a*, an ultrasonic sensor 184*b*, and a laser displacement sensor 184*c*. The gyro sensor 184*a* may be used to detect an acceleration direction, speed, and position change value of the putter head, the ultrasonic sensor 184*b* may be used to detect a change in height according to the stroke of the putter head by detecting a change in interval between a lower surface of the putter head and the ground in real time, and the laser displacement sensor 184*c* may be used to detect two-dimensional position change data of the putter head. In this case, the control part 181 may accurately calculate the stroke direction and stroke speed of the putter head as coordinate values in a three-dimensional space on the basis of data acquired from the gyro sensor 184*a*, the ultrasonic sensor 184*b*, and the laser displacement sensor 184*c*. In this case, the control part 181 may determine whether the stroke direction and stroke speed value of the putter head are suitable for a range input by the user and the putting style desired by the user on the basis of a reference data value previously stored therein, and output the determination result and contents to be corrected to the user or the user's smart device through the image output part 189.

As shown in FIGS. 9 and 10, as a configuration mounted in a changeable position structure inside the main body part 110, the center of gravity variation part 185 according to the embodiment may have a structure which has a changeable position in a direction parallel to a longitudinal direction in which the main body part 110 extends by a control signal of the control part 181 and which has a weight of a predetermined size.

Specifically, the center of gravity variation part 185 may include a position change rail 185*a*, a position change weight 185*b*, and a position change drive part 185*c* having specific structures. As a rail structure extending to a predetermined length therein in the extension direction of the main body part 110, the position change rail 185*a* of the center of gravity variation part 185 is equipped with the position change weight 185*b* and configured to have a changeable position. In this case, the position change drive part 185*c* operated according to the control signal of the control part 181 is mounted on a lower surface of one side of the position change weight 185*b*.

As a configuration mounted on one side surface of the main body part 110, the sleeve angle change part 186 according to the embodiment has a structure operated by the control signal of the control part 181 to change a slope of the sleeve mechanism 150.

As a configuration mounted to independently emit light to each of the weight mounting grooves 140, the light-emitting display part 187 according to the embodiment may be operated according to the control signal of the control part 181.

As a configuration attached to a grip portion of the shaft bound to the sleeve mechanism 150, the switch part 188 according to the embodiment may receive a signal value by a pressing operation of a user's finger and transmit the input signal to the wireless communication module 182.

In addition, as a configuration mounted on the upper surface of the blade formation part 130, the image output part 189 according to the embodiment may visually output data related to the putting operation according to the control signal received from the control part 181.

In this case, as a configuration mounted inside the main body part 110, the control part 181 according to the embodiment may control operations of the center of gravity variation part, the sleeve angle change part 186, and the light-emitting display part 187 on the basis of a preset input value and data acquired from the first detection part 183 and the second detection part 184.

The wireless communication module 182 mounted inside the control part 181 may receive an input value input by the user by wirelessly interlocking with the user's smart device and transmit the input value to the control part 181, and transmit to the control part 181 a signal received from the switch part 188 by wirelessly interlocking with the switch part 188.

In this case, the embodiment may provide the putter which includes the control part 181, the wireless communication module 182, the first detection part 183, the second detection part 184, the center of gravity variation part 185, the sleeve angle change part 186, the light-emitting display part 187, the switch part 188, and the image output part 189, and can be operated to be automatically customized to the golfer by operating the center of gravity variation part 185, the sleeve angle change part 186, and the light-emitting display part 187 by receiving the input putting style and the putting style to be corrected through the user's smart device, and then analyzing the golfer's putting style through the first detection part 183 and the second detection part 184 to calculate the optimal center of gravity and the angle of the shaft customized to the input putting style and the putting style to be corrected on the basis of the analyzed data.

As described above, a putter according to the present disclosure can include a main body part, a downward extension part, a blade formation part, a weight mounting groove, and a sleeve mechanism having specific structures, and thus allow an optimal shaft customized to a body shape, a condition, and a use environment of a user to be easily replaced and mounted and the center of gravity of a putter head to be customized to the user's body shape, condition, and use environment to arrange the center of gravity of the putter head at an optimal position, and as a result, includes a structure which can be customized to a golfer's putting style considering a toe hang balance, a heel balance, and a weightless balance.

In addition, a putter according to the present disclosure includes a main body part including a first fastening hole and a second fastening hole having specific structures, and a blade formation part which arranges a plurality of weight mounting grooves at specific positions, and thus allows the center of gravity of a putter head to the user's body shape, condition, and use environment to be customized to arrange the center of gravity of the putter head at an optimal position, and as a result, includes a structure which can be customized to a golfer's putting style considering a toe hang balance, a heel balance, and a weightless balance.

In addition, a putter according to the present disclosure includes a sleeve mechanism including a sleeve main body portion and a shaft binding fastening hole having specific structures and thus allow an optimal shaft customized to the user's body shape, condition, and use environment to be easily replaced and mounted.

In addition, a putter according to the present disclosure includes a control part, a wireless communication module, a first detection part, a second detection part, a center of gravity variation part, a sleeve angle change part, a light-emitting display part, a switch part, and an image output part, and can be operated to be automatically customized to a golfer by operating the center of gravity variation part, the sleeve angle change part, and the light-emitting display part by receiving an input putting style and a putting style to be corrected through a user's smart device, and then analyzing a golfer's putting style through the first detection part and the second detection part to calculate an optimal center of gravity and an angle of a shaft customized to the input putting style and the putting style to be corrected on the basis of the analyzed data.

In the above detailed description of the present disclosure, only specific embodiments thereof have been described. However, it should be understood that the present disclosure is not limited to the particular form described in the detailed description and rather, it should be understood that the present disclosure includes all modifications, equivalents, and substitutions falling within the spirit and scope of the present disclosure as defined by the appended claims.

In other words, the present disclosure is not limited to the specific embodiments and descriptions described above, and those skilled in the art to which the present disclosure pertains may carry out various modifications without departing from the gist of the present disclosure claimed in the claims, and these modifications shall fall within the scope of the present disclosure.

What is claimed is:

1. A putter comprising:

a main body part (110) having a block structure extending to a predetermined length in a direction perpendicular to a putting stroke direction and provided with a binding groove (113) in which a sleeve mechanism (150) is bound to be rotated at a predetermined angle formed in one side surface thereof;

a downward extension part (120) protruding to a predetermined length forward from one side surface of the main body part (110), then extending to a predetermined depth downward, and formed with a head face (122*a*) having a predetermined area;

a blade formation part (130) formed in a plate structure which extends to a predetermined length rearward from a lower end of the downward extension part (120) and has an area having a predetermined size;

a plurality of weight mounting grooves (140) disposed to be spaced a predetermined interval from each other in an upper surface or a side surface of the blade formation part (130) and configured to bind weights (170) in a detachable structure; and a sleeve mechanism (150) mounted in a structure detachably attached to the binding groove of the main body part (110), having a block structure extending to a predetermined height upward, and formed with a shaft binding fastening hole (152) recessed to a predetermined depth from an upper end surface of the sleeve mechanism, wherein the binding groove (113) of the main body part (110) includes:

a central groove (113*a*) having a structure recessed to a predetermined depth at a center of the one side surface of a rear of the main body part (110);

an inclined surface (113*b*) having a structure which forms both sidewalls of the central groove (113*a*) and is tilted at an acute angle in a vertical symmetry form with respect to a virtual horizontal line passing through a center of a hinge binding hole (113*c*); and the hinge binding hole (113*c*) formed at a center of the central groove (113*a*) and bolt-fastened to the sleeve mechanism, and the inclined surface (113*b*) has a structure tilted to come into surface contact with one side surface of the sleeve mechanism when the sleeve mechanism is tilted in one side direction with respect to the hinge binding hole (113*c*).

2. The putter of claim 1, wherein the main body part (110) includes:

a first fastening hole (111) formed in a structure recessed to a predetermined depth in one end surface in the direction perpendicular to the putting stroke direction and having a structure bolt-fastened with a first weight (111*a*); and a second fastening hole (112) formed in a structure recessed to a predetermined depth in another end surface in the direction perpendicular to the putting stroke direction and having a structure bolt-fastened with a second weight (112*a*).

3. The putter of claim 1, wherein the downward extension part (120) includes:

a front connection portion (121) having an upper surface structure which extends to a predetermined length from an upper portion of one side surface facing the front of the main body part (110) and is continued from an upper surface of the main body part (110);

a face formation portion (122) formed with the head face (122*a*) which extends to a predetermined length downward from a lower surface of one end of the front connection portion (121) and forms a loft angle; and a separation space part (123) formed between a lower portion of the one side surface facing the front of the main body part (110) and the face formation portion (122).

4. The putter of claim 1, wherein the blade formation part (130) includes:

one side blade (131) disposed on the one side surface of the main body part (110) in the direction perpendicular to the putting stroke direction, formed in a curved structure having a radius of a predetermined length rearward from the lower end of the downward extension part (120) and having a structure formed to protrude to a predetermined height from an upper surface of the one side to increase a weight of the blade formation part (130); and another side blade (132) disposed on another side surface of the main body part (110) in the direction perpendicular to the putting stroke direction, formed in a curved structure having a radius of a predetermined length rearward from the lower end of the downward extension part (120), and having a structure formed to protrude to a predetermined height from an upper surface of the another side to increase a weight of the blade formation part (130), a plurality of weight mounting grooves (140) are spaced a certain interval from each other and disposed along an edge of the curved structure in a portion formed to protrude from the one side blade (131), and the plurality of weight mounting grooves (140) are spaced a certain interval from each other and disposed along an edge of the curved structure in a portion formed to protrude from the another side blade (132).

* * * * *